US005887299A

United States Patent [19]

Phillips

[11] Patent Number: 5,887,299

[45] Date of Patent: Mar. 30, 1999

[54] CONVERTIBLE MULTI-PURPOSE COVERING

[76] Inventor: Brent S. Phillips, 18 Nelson Ave., Georgetown, Mass. 01833

[21] Appl. No.: 907,400

[22] Filed: Aug. 7, 1997

Related U.S. Application Data

[63] Continuation-in-part of Ser. No. 350,474, Dec. 7, 1994, abandoned.

[51] Int. Cl.[6] ..... A47G 9/04; A47G 9/08

[52] U.S. Cl. ..... 5/413 R; 5/486; 5/502; 5/923

[58] Field of Search ..... 5/413 R, 486, 5/496, 502, 922, 923

[56] References Cited

U.S. PATENT DOCUMENTS

| | | | |
|---|---|---|---|
| 1,267,042 | 5/1918 | Arnold | 5/486 |
| 2,442,105 | 5/1948 | Vacheron . | |
| 2,832,967 | 5/1958 | Sobel | 2/69.5 |
| 3,034,132 | 5/1962 | Landsberger et al. . | |
| 3,510,889 | 5/1970 | Peterson . | |
| 3,831,206 | 8/1974 | Geary | 5/413 |
| 4,158,892 | 6/1979 | Gonzales . | |
| 4,217,662 | 8/1980 | Buchman | 2/69.5 |
| 4,238,871 | 12/1980 | Cannon | 5/413 |
| 4,413,368 | 11/1983 | Schuetze | 5/413 |
| 4,573,227 | 3/1986 | Prandina | 5/502 |
| 4,631,765 | 12/1986 | Casey | 5/502 |
| 5,159,727 | 11/1992 | McCracken . | |
| 5,243,724 | 9/1993 | Barnes . | |
| 5,257,427 | 11/1993 | Hinshaw | 5/420 |
| 5,353,456 | 10/1994 | Evans | 5/486 |
| 5,533,216 | 7/1996 | Thier | 5/413 R |
| 5,664,269 | 9/1997 | Broder | 5/486 |
| 5,713,089 | 2/1998 | Ferrante | 5/502 |

FOREIGN PATENT DOCUMENTS

| | | | |
|---|---|---|---|
| 2 342 188 | 9/1977 | France . | |
| 166260 | 5/1904 | Germany | 5/502 |
| 2 224 640 | 5/1990 | United Kingdom . | |

*Primary Examiner*—Kenneth J. Dorner
*Assistant Examiner*—Robert G. Santos
*Attorney, Agent, or Firm*—Mills Law Firm PLLC; Clifford F. Rey

[57] ABSTRACT

A convertible multi-purpose covering is disclosed being formed of pair of similarly shaped and sized flexible sheets of material having predetermined surfaces and edges positioned in face-to-face relationship at a first location. The sheets are aligned along their edges and connected along the top and side marginal edges leaving the sheets bottom edges open and thereafter turning the connected sheets right-side-out. Insulating filling sufficiently shaped, sized or volumed is inserted through the opening and arranged to evenly fill the space between the connected sheets, with the sheets then being connected along the bottom marginal edges to close the opening forming a comforter body. Two pluralities of fasteners arranged in parallel longitudinal rows are attached to the top surface of the body along the right side edge. Two pluralities of fasteners arranged in parallel longitudinal rows are attached to the bottom surface of the body along the left side edge, and another plurality of fasteners in a lateral row are attached to the bottom surface of the body along the bottom edge to permit detachable connections and conversion of coverings to form several optional bedding items such as comforters, sleeping bats and body wraps as examples, and provide convenient laundering.

34 Claims, 10 Drawing Sheets

FIG. 13
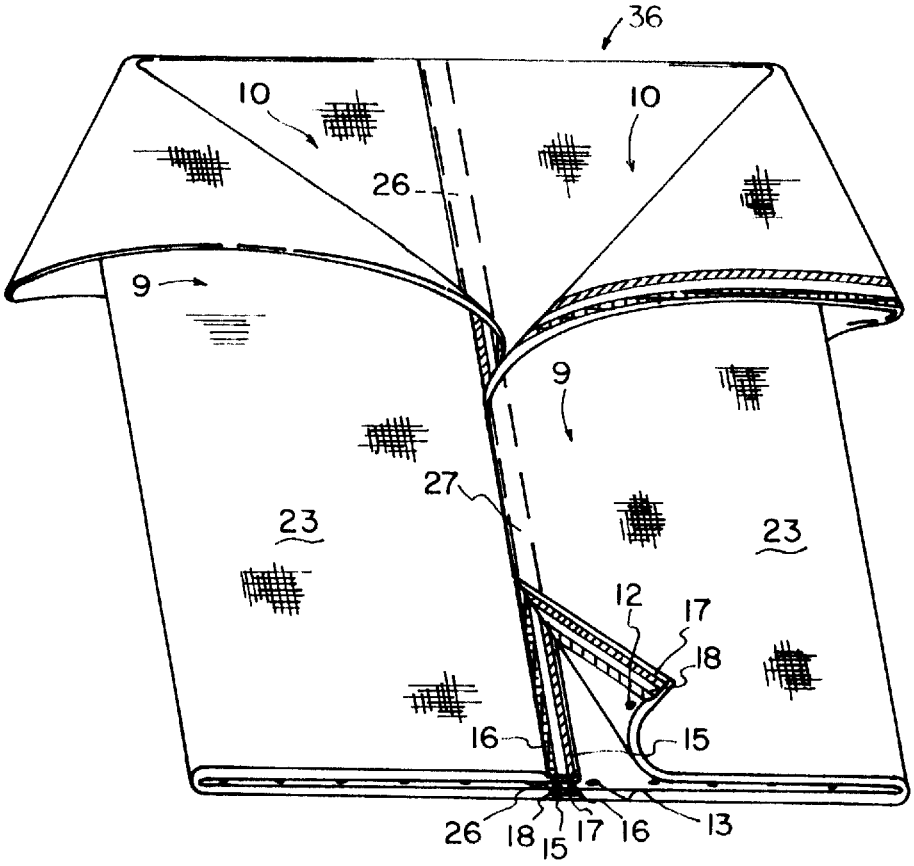
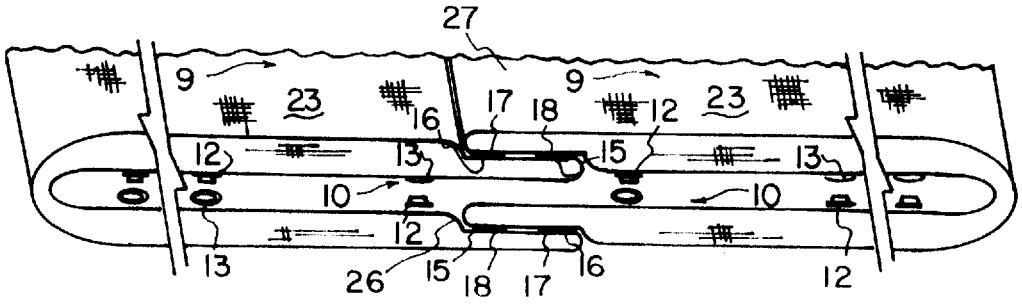
FIG. 14

FIG. 15
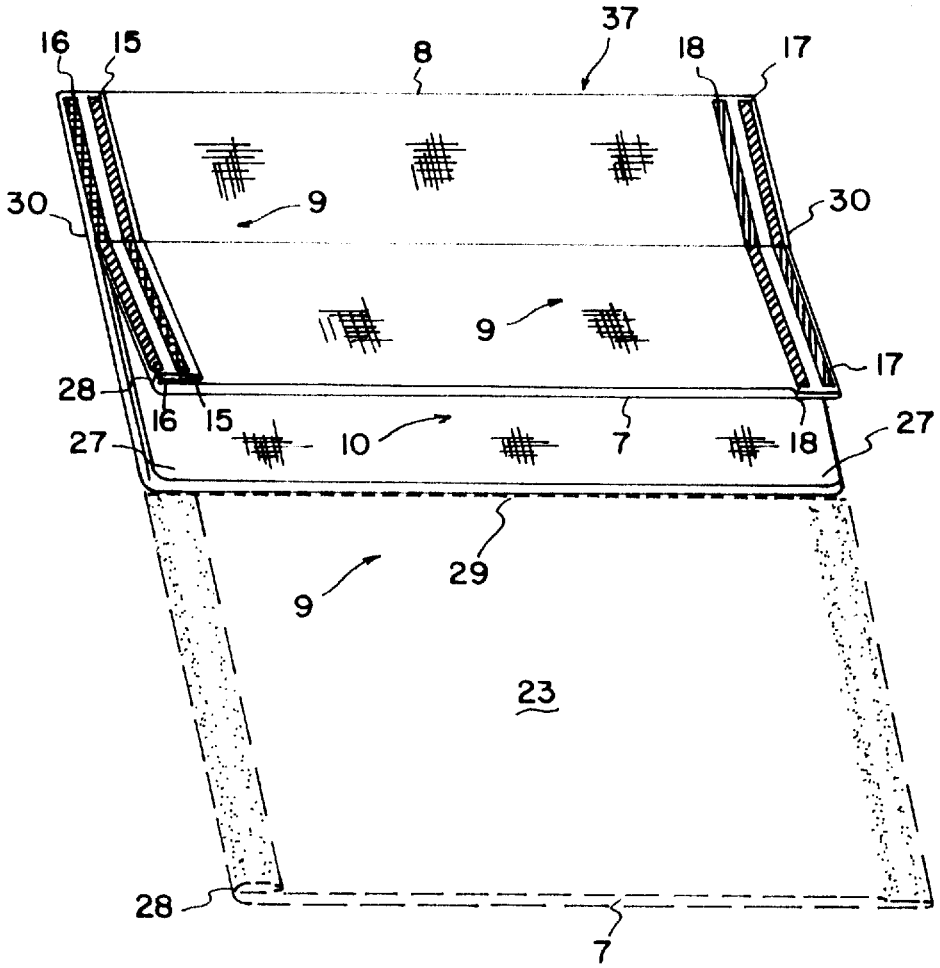
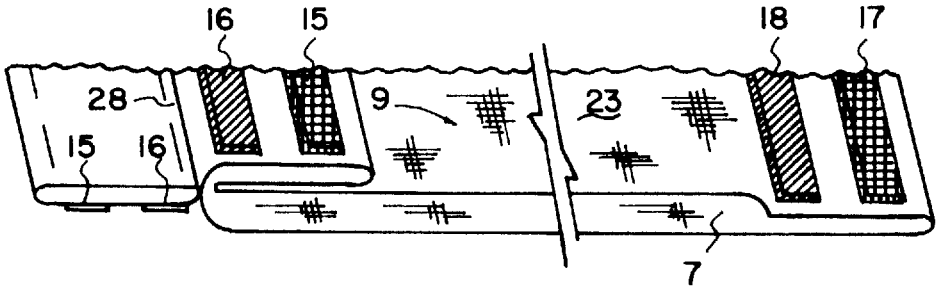
FIG. 16

CONVERTIBLE MULTI-PURPOSE COVERING

This application is a continuation-in-part of application Ser. No. 08/350,474 filed Dec. 7, 1994 now abandoned.

BACKGROUND OF THE INVENTION

Field of the Invention

The invention generally concerns coverings and more particularly, convertible multipurpose bed coverings adapted to be singularly converted or detachably connected together and converted to form several optional adult, adolescent and infant size bedding items such as larger and smaller sized bed comforters, quilted blankets, body wraps, single and double sleeping bags as examples, and provides for convenient laundering of the coverings.

Fabric bed comforters have long been used for keeping the body warm when sleeping or when in cool surroundings. Sleeping bags have also long been used to keep the body warm, particularly when in outdoor environments. To increase the versatility of such bedding, several convertible bedding articles have been created serving as both a standard blanket and a sleeping bag or forming other such warming articles.

One such convertible bedding is shown in U.S. Pat. No. 2,442,105 issued to L. Vacheron on May 25, 1948. In this patent, a design for a multipurpose blanket is disclosed. This blanket is square in shape and is equipped with slide fasteners disposed about the entire periphery of the blanket. These slide fasteners allow the blanket to be arranged in several configurations. One of these configurations takes the form of a standard sleeping bag, substantially rectangular in shape and open at one end to permit a person to slide between the top and bottom layers of the bag. While adequately serving as both a blanket and a sleeping bag, the invention of this patent is large and, as such, may be difficult to clean in a standard automatic washing machine. In addition, no provision is made for covering the slide fastener elements of the blanket. With these slide fasteners exposed about all edges of the blanket, they are likely to irritate the blanket user, zipper teeth coming in direct contact with the skin.

Similar convertible bedding have been created in the art of infant bedding. One such bedding is shown in U.S. Pat. No. 3,034,132 issued to Landsberger et al. on May 15, 1962. In this patent, an infant's blanket is described in which an infant may be wrapped. The blanket is square in shape and secures about the infant with either snap or hook and loop fasteners. Although this particular design works well for keeping a small infant warm, such a design would be impractical for an adult comforter since the blanket would be required to be very large. As with the blanket of the Vacheron patent, a blanket of such large dimensions most likely could not be machine washed.

Other bedding designs related to the present invention appear in the art of sleeping bag design. In U.S. Pat. No. 3,510,889 issued to J. A. Peterson on May 12, 1970 and U.K. Pat. No. GB 2-224-640-A issued to Martin Bato on May 16, 1990, two person sleeping bags are disclosed that are formed by joining two single person sleeping bags together along their respective seams. In addition, the sleeping bag of the Peterson patent is convertible, allowing the user to change the top cover of the sleeping bag so that top covers of various thicknesses and therefore various warming properties may be selected. While the sleeping bag designs of both of these patents may be spread out to form large blankets, none of them provide for enclosing the bag's fastening elements, these elements left exposed.

None of the above inventions and patents, taken either singularly or in combination, is seen to describe the instant invention as claimed.

The present invention concerns, but is not limited to, convertible multipurpose coverings adapted to be singularly or detachably connected together and converted to form several optional adult, adolescent and infant size bedding items such as bed comforters, sleeping bags, body wraps and quilted blankets as examples, and provides for convenient laundering of the coverings. The coverings are constructed of a pair of natural, synthetic or blended flexible sheets of material similarly sized, generally rectangular in shape, with predetermined surfaces and edges positioned in face-to-face relationship at a first location, aligned along the sheets like marginal edges, connected together along the sheet's top and side marginal edges leaving the sheet's bottom edges open and turning the connected sheets right-side-out. Insulating filling material of sufficient shape, size or volume is then inserted through the opening at the sheet's bottom edges and arranged to evenly fill the space between the two connected sheets with the sheets then being connected together along the sheet bottom marginal edges closing the opening form a comforter-like body. Affixed to the top surface of the body along the right side marginal edge are two pluralities of fastening elements arranged in longitudinal rows at predetermined, spaced apart locations paralleling each other, affixed to the bottom surface of the body along the left side marginal edge are two additional pluralities of fastening elements arranged in the same manner. Also affixed to the bottom surface of the body along the bottom marginal edge are a plurality of elements arranged in a lateral row of alternating male-type and female-type fasteners at regular, predetermined intervals. These fasteners are arranged and of suitable types to permit detachable connections for multiple conversions of a singular covering, and at least two detachably connected coverings.

One of the principle objects of the invention is to provide larger size bed comforters or quilted blankets by conversion of two detachably connected coverings, that can be conveniently laundered in standard household size washing or drying machines safely without overloading by simply detaching the two coverings and laundering each covering separately.

It is another object of the invention to provide optional smaller size bed comforters or quilted blankets by conversion of a singular covering.

It is yet another object of the invention to provide optional adult size single sleeping bags or body wraps by conversion of a singular covering.

It is still yet another object of the invention to provide optional adult size double sleeping bags by conversion of two detachably connected coverings.

It is yet further an object of the invention to provide optional infant and adolescent size double sleeping bags or body wraps by conversion of a singular covering.

It is still further another object of the invention to provide optional infant and adolescent size extra cushioned single sleeping bags or body wraps by conversion of a singular covering.

Furthermore, the invention is also intended to be assembled using different colored, patterned, printed and textured surfaces permitting the covering to be inverted for greater appearance versatility.

Other objects and advantages of the present invention will become apparent and obvious from a study of the following description and the accompanying drawings which are merely illustrative of such invention.

BRIEF DESCRIPTION OF THE DRAWINGS

The various features, advantages and optional uses of the invention will become more apparent by referring to the following drawings in which:

FIG. 13 is a plan view of a fifth embodiment as a double sleeping bag;

FIG. 14 is an enlarged perspective view showing the bottom marginal edge of FIG. 13;

FIG. 15 is a plan view of a sixth embodiment as a child size double sleeping bag or pocket;

FIG. 16 is an enlarged perspective view showing the bottom marginal edge and the initial step for configuring the embodiment illustrated in FIG. 15;

DESCRIPTION OF THE PREFERRED EMBODIMENT

Figure 1:
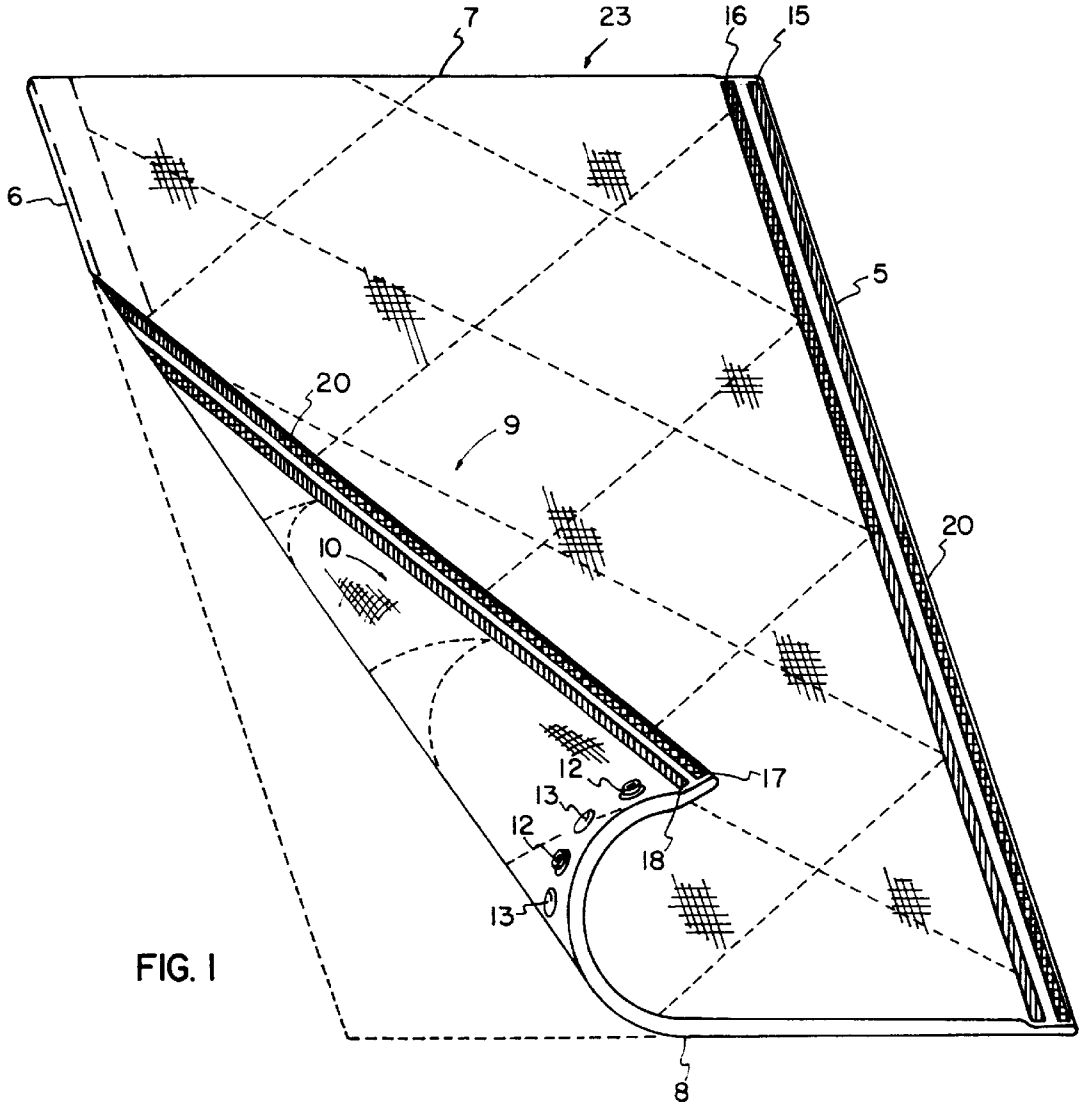
FIG. 1. is a plan view showing the invention in its preferred rectangular shape of a comforter-like body having hook and loop fastening strips arranged in parallel longitudinal rows with opposing polarities attached to the top surface along the right side marginal edge; hook and loop fastening strips arranged in parallel longitudinal rows with opposing polarities attached to the bottom surface along the left side marginal edge; and a plurality of snap fasteners arranged in a lateral row of alternating male and female segments at regular intervals attached to the bottom surface along the bottom marginal edge.

Referring now to FIG. 1 there is shown therein a covering 23 in accordance with the present invention of a bed comforter embodiment generally rectangular in shape and of variable dimensions according to a size suitable for its intended use. Affixed to the top surface 9 at predetermined, spaced apart locations along the right side marginal edge 5 are two pluralities of fastening elements disposed in longitudinal rows paralleling each other as at 15 and 16 consisting of hook and loop fasteners strips in the preferred embodiment. Fastening element 15 is arranged with a strip of the hook fastener commencing adjacent the top marginal edge 7 and continuing midway between the top and bottom marginal edges as at 20, and then continuing with a strip of the loop fastener terminating adjacent the bottom marginal edge 8.

Fastening element 16 is positioned at a predetermined spaced apart location towards the center of the body adjacent and paralleling fastening element 15 with its hook and loop fastener strips arranged in the same manner opposing the polarities of fastening elements 15.

Affixed to the bottom surface 10 at predetermined, space apart locations along the left side marginal edge 6 are two pluralities of fastening elements in longitudinal rows paralleling each other as at 17 and 18 consisting of hook and loop fastener strips in the preferred embodiment. Fastening element 17 is arranged with a strip of the hook fastener commencing adjacent the top marginal edge 7 continuing midway between the top and bottom marginal edges as at 20, and then continuing with a strip of the loop fastener terminating adjacent the bottom marginal edge 8.

Fastening element 18 is positioned at a predetermined spaced apart location towards the center of the body adjacent and paralleling fastening element 17 with its hook and loop fastener strips arranged in the same manner opposing the polarities of fastening elements 17.

Also affixed to the bottom surface 10 at predetermined locations along the bottom marginal edge 8 are a plurality of fastening elements in a lateral row as at 12 and 13 consisting of snap fasteners in the preferred embodiment. These snap fasteners are arranged exposing their functional portion exteriorally to the bottom surface at predetermined, spaced apart intervals with alternating male 12 and female 13 segments in equal numbers, commencing with a male segment 12 located towards the center of the body adjacent fastening elements 18, and terminating with the female segment 13 located towards the center of the body adjacent fastening elements 16. These fastening elements are arranged to permit detachable connections for coverings multiple optional uses as shown in the following figures.

Fastening elements 15, 16, 17 and 18 are representative of a myriad of other possible fasteners providing detachable connection, such as, slide fasteners, buttons and holes, magnetic clasps or snap fasteners which can be used with the present invention. Fastening elements 12 and 13 are also representative of a myriad of other fasteners providing detachable connections, such as slide fasteners, hook and loop, buttons and holes or magnetic clasps for examples. All fastening devices have their advantages and disadvantages. The key to employing any fastening device is to arrange the fasteners to optimize variations in configurations and assembly of the coverings. The inventor's arrangement and preferred fastening devices described and illustrated in FIG. 1 will be understood by those skilled in the art upon reviewing the following figures.

Figure 2:
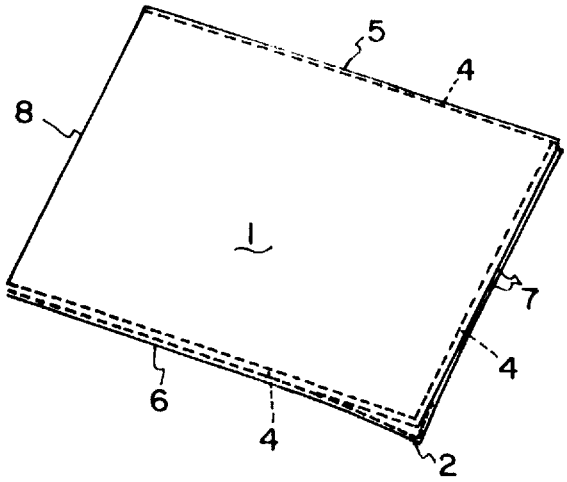
FIG. 2 is a perspective view showing the initial construction details of FIG. 1.

As shown in FIG. 2, each covering 23 is constructed of a pair of natural, synthetic or blended flexible sheets of material 1 and 2 of the same size, generally rectangular in shape with predetermined surfaces and edges positioned in face-to-face relationship at a first location, aligned along their like marginal edges 5, 6, 7 and 8 and connected together adjacent their right side 5, left side 6, and top 7 marginal edges by a row of stitches 4 passing through the sheets of material leaving their bottom edges 8 open.

Figure 3:
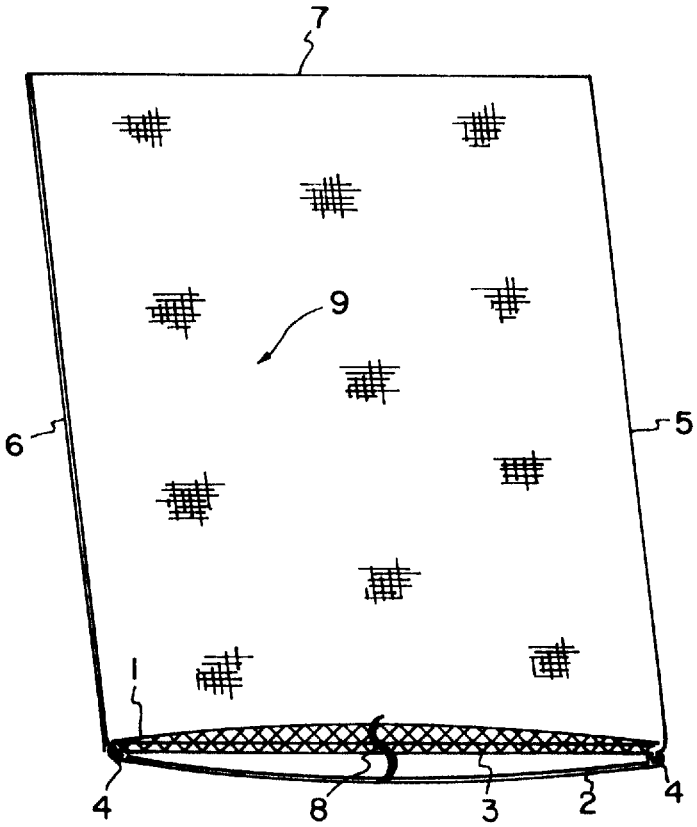
FIG. 3 is a perspective view showing further construction details of FIG. 1.

As shown in FIG. 3, the connected sheets are then turned right-side-out and insulated filling material 3 of sufficient shape, size or volume is inserted between the attached sheets through opening at the sheet's bottom edges as at 8, and arranged to evenly fill the space between the two connected sheets.

Figure 4:
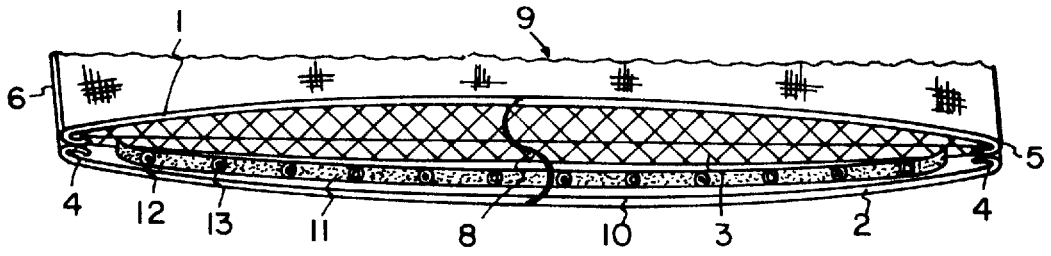
FIG. 4 is an enlarged perspective view showing the bottom marginal edge of FIG. 3.

Affixed to the bottom surface 10 as shown in FIG. 4 which is an enlarged view of the sheets bottom marginal edges 8 illustrated in FIG. 3 are a plurality of aligned fastening elements consisting of six male 12 and six female 13 snap fasteners, although the number of these fasteners can vary depending on preference so long as they remain equally numbered in the mating male and female segments. These snap fasteners are attached through the bottom surface sheet exposing their functional portion externally and are arranged and located as previously described in FIG. 1 and further explained and illustrated in FIG. 12, FIG. 14 and FIG. 19 with an optional reinforcement strip 11 positioned to the interior of the connected sheets if desired.

Figure 5:
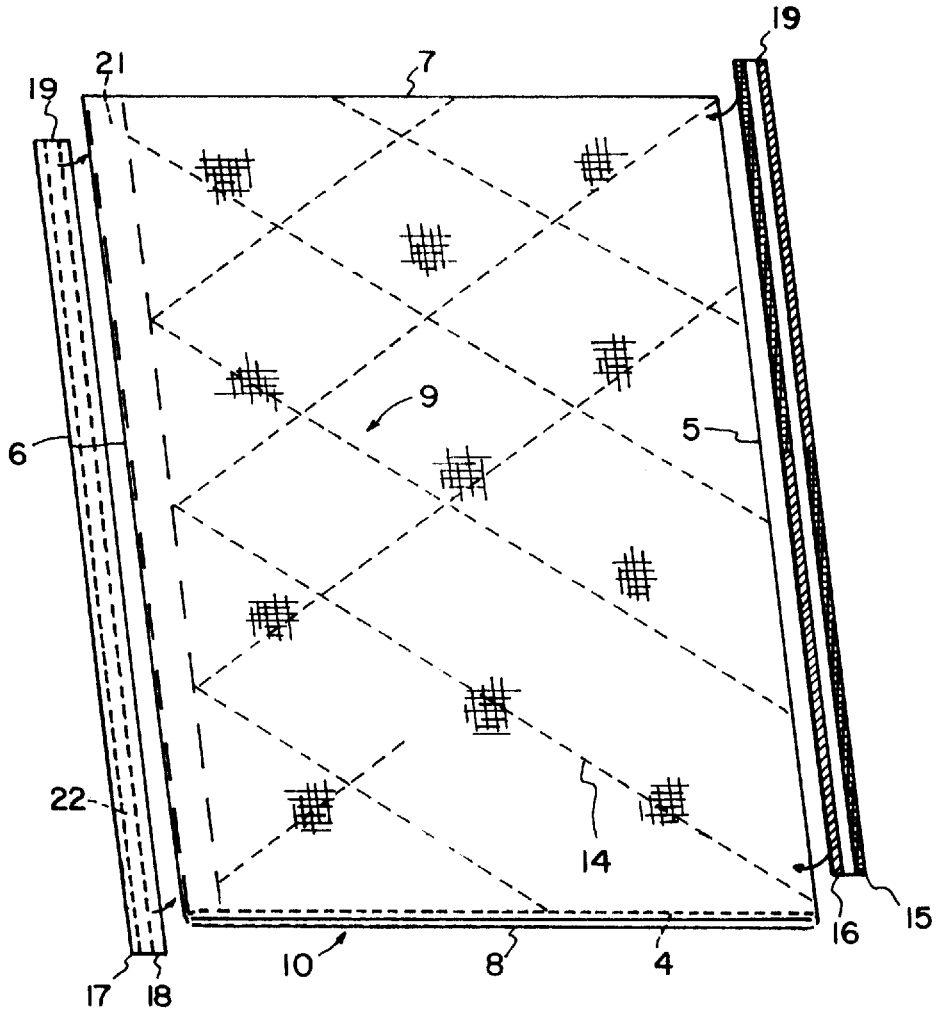
FIG. 5 is a perspective view showing the final construction details of FIG. 1.

Alternatively, these snap fasteners can be attached through the covering body after the sheet's bottom edges have been connected together closing the opening as shown in FIG. 5 by a row of stitches 4 adjacent the sheet's bottom marginal edges 8 and passing through the sheet's bottom edges to form a comforter-like body.

Figure 6:
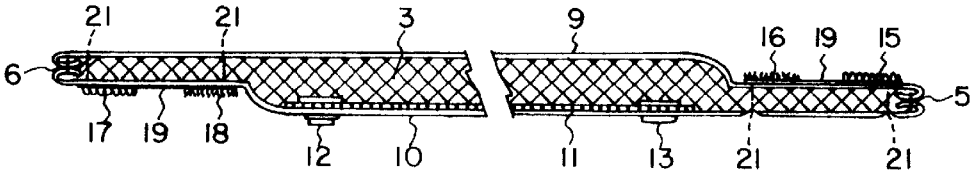
FIG. 6 is an enlarged cross-sectional view through the bottom edge of FIG. 5 showing the resulting construction.

An optional quilt pattern can then be stitched through body as illustrated by rows of stitching 14 to help hold the insulating filling in place, and fastening elements 15, 16, 17 and 18 are attached to the top and bottom surfaces 9 and 10 of the covering body located and arranged as previously described in FIG. 1 by rows of stitches passing through each individual fastening element and the covering body separately. Or, alternatively by first attaching the appropriate fastening elements to an attaching strip 19 by rows of stitches 22 passing through the individual fastening elements and the attaching strip, and then securing the attaching strips to the covering body by rows of stitches 21 passing through the fastening elements outer most marginal edges, the attaching strip, and the covering body as shown in FIG. 6, which is an enlarged cross-sectional view through the bottom marginal edge 8 of FIG. 5 showing the resulting construction of a completed singular covering 23. This particular construction permits a singular covering and at least two detachably connected coverings to be easily configured into several optional bedding items as explained and illustrated in the following figures.

Figure 7:
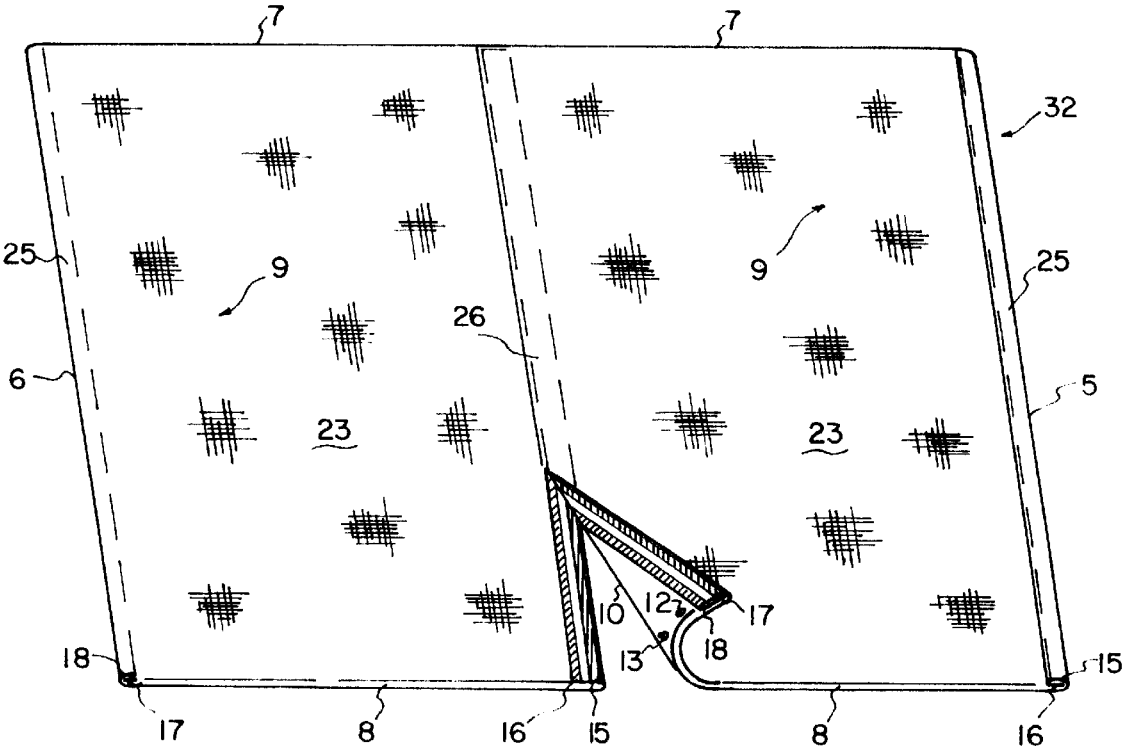
FIG. 7 is a plan view of the invention as a larger bed comforter or quilted blanket.
Figure 8:
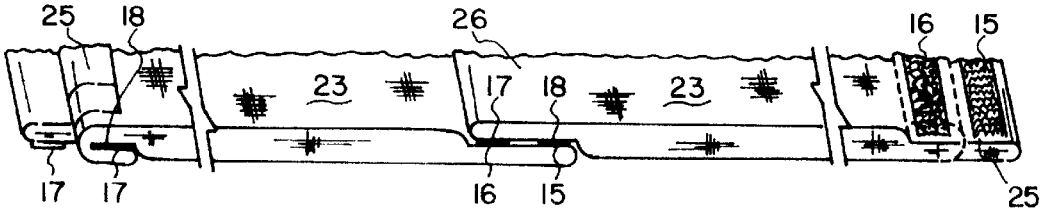
FIG. 8 is an enlarged perspective view showing the bottom marginal edge of FIG. 7.

For example, as shown in FIG. 7, and FIG. 8 which is an enlarged view showing the bottom edges of FIG. 7, two coverings 23 and 23 can be detachable connected together to form a relatively large bed comforter or quilted blanket 32 by positioning the two coverings, the first covering to the left, the second covering to the right, each covering's snap fasteners 12 and 13 facing down and toward the user aligning the two coverings top and bottom edges 7 and 8, overlapping and aligning fastening elements 17 and 18 of the second covering on top of fastening elements 15 and 16 of the first covering and engaging their opposing fastening elements in face-to-face relationship to form a secure insulated attaching seam as at 26, that conceals these fastening elements for comfort and appearance purposes to the user.

This configuration is completed by folding the first covering longitudinally between fastening elements 17 and 18 aligning and engaging their opposing fastening elements in face-to-face relationship to hold the fold in place form a finished edge as at 25 and repeating these same steps on the second covering with fastening elements 15 and 16 to form finished edges on each side/end of the attached coverings 23 in order to conceal these fastening elements for appearance and comfort purposes to the user as well.

Figure 9:
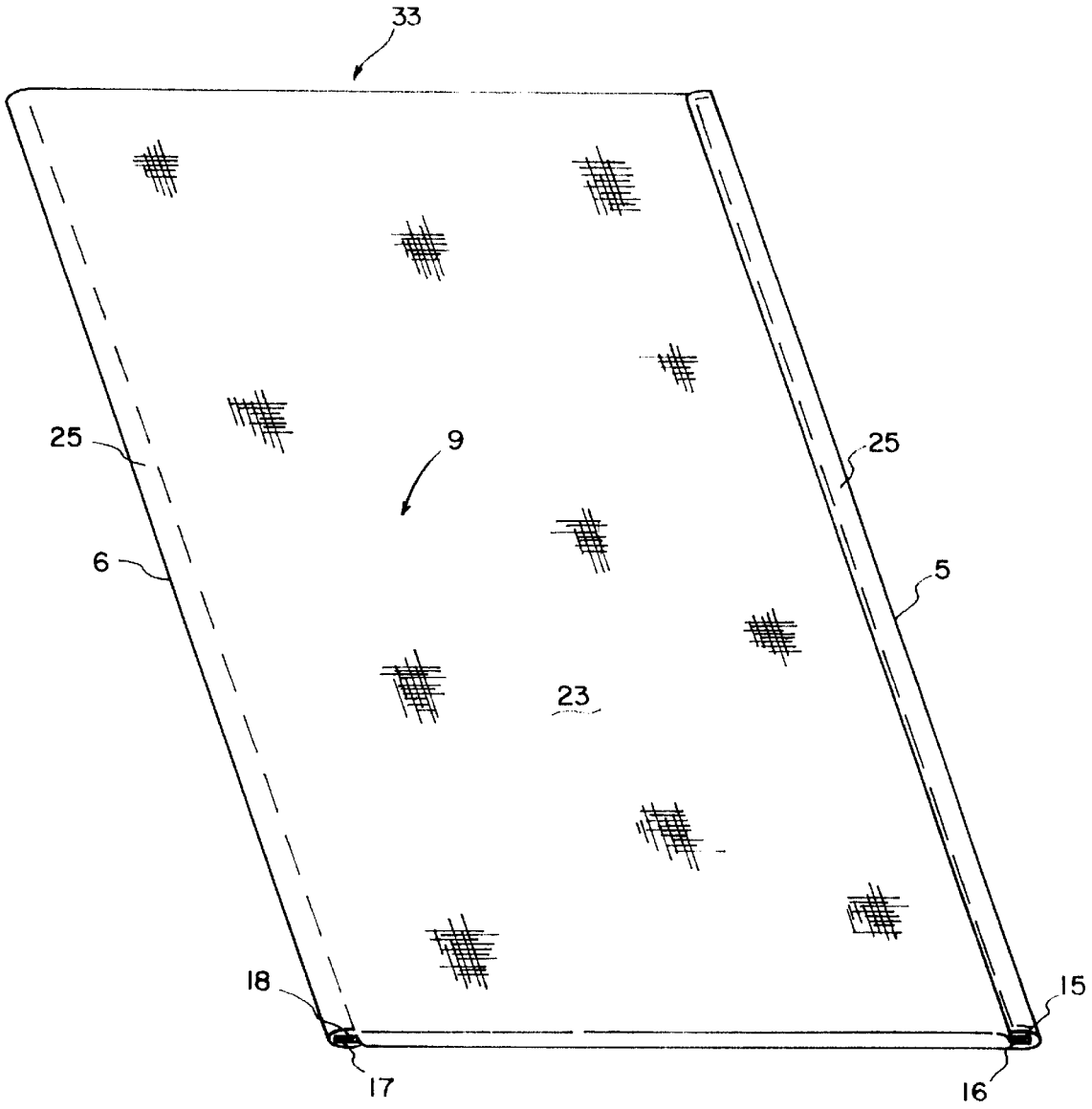
FIG. 9 is a plan view of a second embodiment as a smaller bed comforter or quilted blanket.

These larger size bed comforters or quilted blankets 32 can also be conveniently laundered in a standard household size washing or drying machine safely without overloading by simply detaching the two coverings 23 and laundering each covering separately after engaging fastening elements 15 and 16, and fastening elements 17 and 18 on each covering as illustrated in FIG. 9 to prevent these fastening elements from being exposed to tangle during the laundering process.

As shown in FIG. 9, a singular covering 23 can be configured into a smaller size bed comforter or quilted blanket 33 by folding the covering longitudinally between fastening elements 15 and 16 aligning and engaging their opposing fastening elements 15 and 16 aligning and engaging their opposing fastening elements in face-to-face relationship to hold the fold in place forming a finished edge as at 25, and repeating these same steps with fastening elements 17 and 18 to form finished edges on each side/end of the covering in order to conceal these fastening elements for appearance and comfort purposes to the user.

Figure 10:
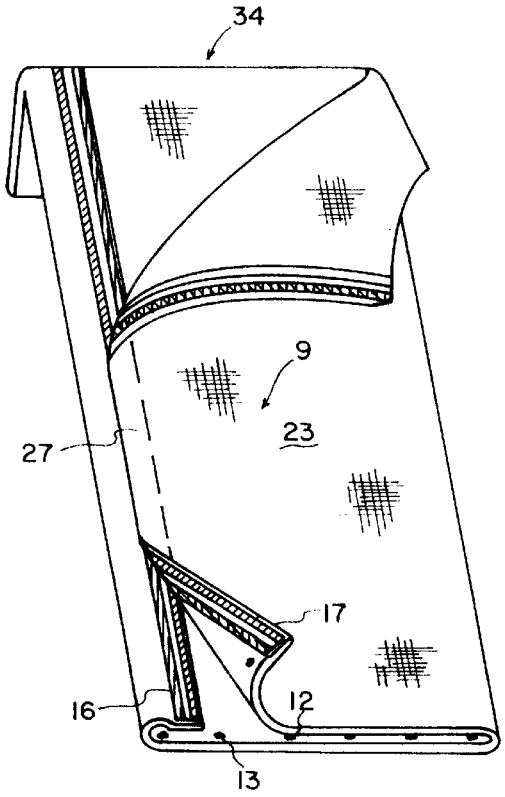
FIG. 10 is a plan view of a third embodiment as a single sleeping bag.
Figure 11:
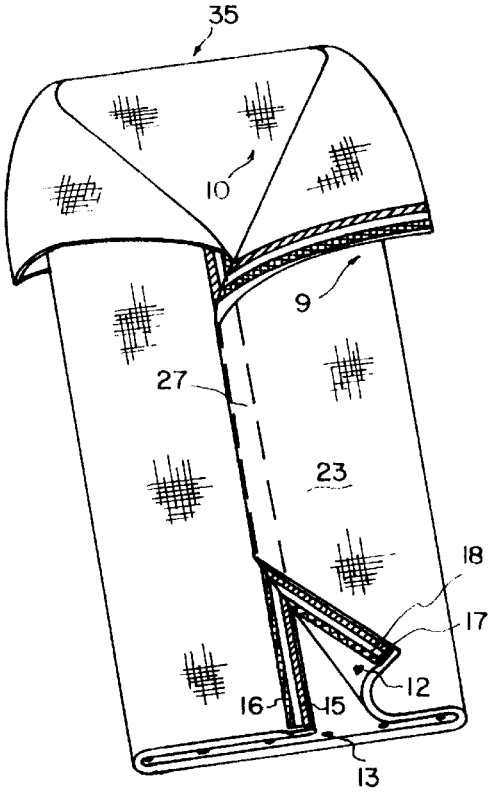
FIG. 11 is a plan view of a fourth embodiment as a body wrap.

As shown in FIG. 10 and FIG. 11 a singular covering 23 can be configured into a sleeping bag 34 or body wrap 35 by positioning the covering with the snap fasteners 12 and 13 facing up and toward the user, folding the covering longitudinally to overlap fastening elements 17 and 18 on top of fastening elements 15 and 16 positioned either off-set or centered on top of the folded covering for the desired configuration, aligning and engaging their opposing fastening elements in face-to-face relationship to form a secure insulating enclosure seam as at 27, in order to conceal these fastening elements for appearance purposes and to provide easy entry and exit of the sleeping bag or body wrap.

Figure 12:
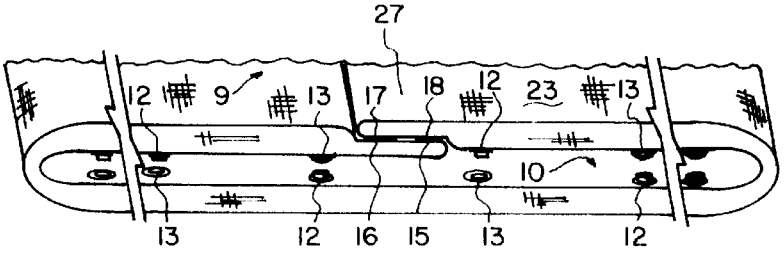
FIG. 12 is an enlarged perspective view showing the bottom marginal edge of FIG. 11.

This configuration is completed by aligning and engaging the alternating snap fasteners 12 and 13 shown in FIG. 12 which is an enlarged view showing the bottom edge of FIG. 11, positioned between the covering's folds for enclosing the bottom portion of the sack-like embodiment and adjusting the length by rolling down the covering's end opposite the snap fasteners providing the user additional back, neck and head cushioning.

FIG. 12 also illustrates snap fasteners 12 and 13's consistent spacing, alignment and continuity to include each side of the enclosure seam 27 when a single covering is folded over.

As shown in FIG. 13, two coverings 23 and 23 can be connected together and configured into a double sleeping bag 36 by positioning the two coverings side-by-side, the first covering to the left, the second covering to the right, with each covering's snap fasteners 12 and 13 facing up and toward the user aligning the two covering's top and bottom edges 7 and 8, overlapping and aligning fastening elements 15 and 16 of the second covering on top of fastening element 17 and 18 of the first covering and engaging their opposing fastening elements in face-to-face relationship to form a secure insulated attaching seam as at 26 to conceal these fastening elements and continuing the configuration process by folding each covering longitudinally to overlap and align fastening elements 17 and 18 of the second section on top of fastening elements 15 and 16 of the first section positioned on top of the attaching seam 26 and engaging their opposing fastening elements in face-to-face relationship to form a secure insulated enclosure seam as at 27 to conceal these fastening elements, and to provide easy entry and exit of the sleeping bag.

This configuration is completed by engaging the alternating snap fasteners 12 and 13 shown in FIG. 14, which is an enlarged view showing the bottom edges of FIG. 13, positioned between the connected coverings folds for enclosing the bottom portion of the sack-like embodiment and adjusting its length by rolling down the end opposite the snap fasteners providing the user additional back, neck and head cushioning as well.

FIG. 14 also illustrates snap fasteners 12 and 13's consistent spacing, alignment and continuity to include each side of the attaching seam 26 and enclosure seam 27 when two coverings are detachably connected together and folded over.

As shown in FIG. 15, and FIG. 16, which is an enlarged view showing the initial fold to configure a singular covering 23 into a child sized double sleeping bag or pocket 37 by positioning the covering with the snap fasteners 12 and 13 facing down and away from the user, folding over the covering longitudinally along fastening elements 15 and 16 so fastening elements 15 and 16 are facing up on top of the covering along the covering's left side edge as at 28, then folding the covering in half creasing it where fastening elements 15 and 16, and fastening elements 17 and 18 reverse polarity midway between the covering's top and bottom marginal edges as at 29, overlapping and aligning fastening elements 1 5 and 16, and fastening elements 17 and 18 onto themselves as at 30, and engaging their opposing fastening elements in face-to-face relationship to form a secure insulated enclosure seam as at 27 that conceals these fastening elements and provides for easy entry and exit on each side of the sleeping bag or pocket.

Figure 17:
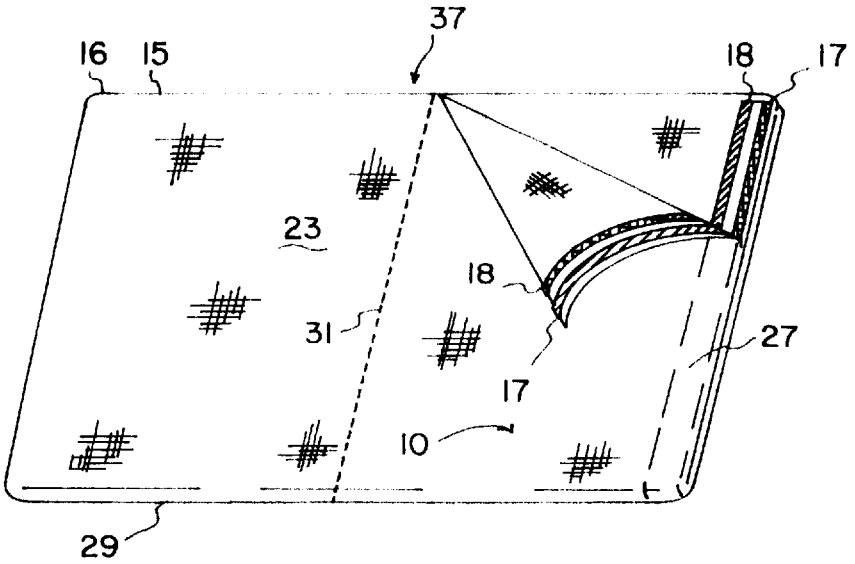
FIG. 17 is another plan view of FIG. 15 prior to forming a seventh embodiment as illustrated in FIG. 18.
Figure 18:
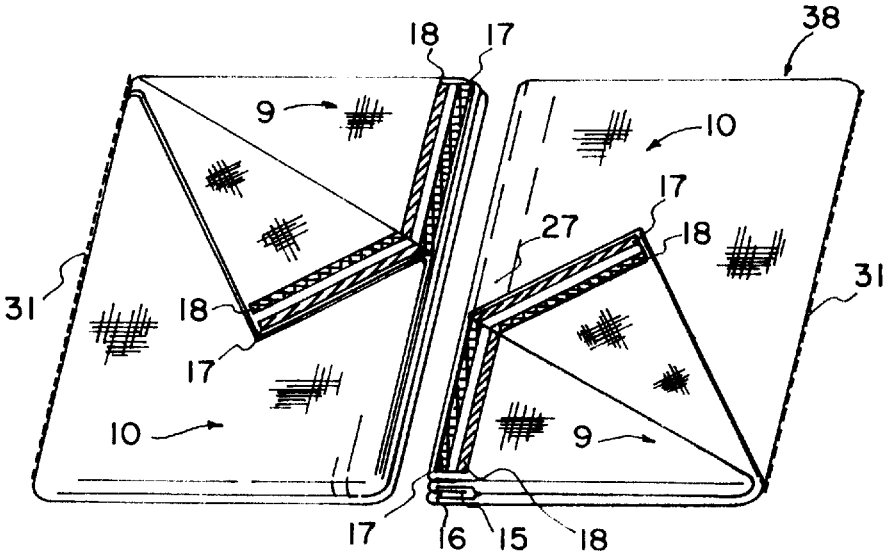
FIG. 18 is a plan view of a seventh embodiment as a child size extra cushioned sleeping bag.
Figure 19:
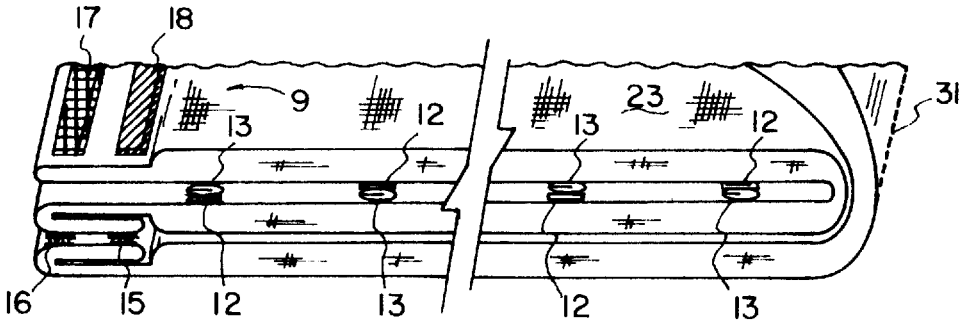
FIG. 19 is an enlarged perspective view showing the right hand illustration's top marginal edge of FIG. 18.

As shown in FIG. 17 and FIG. 18, a singular covering 23 can be configured into a child size extra cushioned sleeping bag 38 by following the previously described steps for configuring the child size double sleeping bag 37, continuing the child size extra cushioned sleeping bag configuration by folding the covering in half again as illustrated by fold line 31 so fastening elements 17 and 18 are stacked on top of fastening elements 15 and 16 to one of the folded covering's side edges as shown in FIG. 19 which is an enlarged view showing the lower portion of 38.

This configuration is completed by aligning and engaging the snap fasteners 12 and 13 positioned between the covering's folds to hold the fold in place allowing the top two fastening elements 17 and 18 to form a secure insulated enclosure seam as at 27 to conceal these fastening elements for appearance purposes and to provide for easy entry and exit of the sleeping chamber located between the top two layers of the folded covering, and to provide three layers of cushioning under the sleeping chamber for added comfort.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The principle and mode of operation of the present invention, in accordance with the provisions of the patent statutes have been explained and illustrated in its preferred embodiment(s). However, it must be appreciated that the present invention can be practiced otherwise than as specifically explained and illustrated without departing from its spirit or scope.

I claim:

1. A convertible bed comforter comprising:

a first comforter section and a second comforter section, each of said comforter sections including a top surface, a bottom surface, a right edge, a left edge, a top edge and a bottom edge; and a first, a second, a third, and a fourth primary fastening element, and a first, a second, a third, and a fourth secondary fastening element, each said primary fastening element adapted to mate with one of said secondary fastening elements, said first primary fastening element secured to the top surface of said first comforter section along its right edge, said first secondary fastening element secured to the top surface of said first comforter section adjacent said first primary fastening element, said second primary fastening element secured to the bottom surface of said second comforter section along its left edge, said second secondary fastening element secured to the bottom surface of said second comforter section adjacent said second primary fastening element, said first primary fastening element connectable with said second secondary fastening element and said second primary fastening element connectable with said first secondary fastening element to detachably fasten said right edge of said first comforter section to the left edge of said second comforter section, said third primary fastening element secured to the bottom surface of said first comforter element along its left edge, said third secondary fastening element secured to the bottom surface of said first comforter section adjacent said third primary fastening element, said third primary fastening element connectable with said third secondary fastening element to detachably fasten said left edge of said first comforter to itself in a folded configuration, whereby said third primary fastening element and said third secondary fastening element are hidden and protected when connected, said fourth primary fastening element secured to the top surface of said second comforter element along its right edge, said fourth secondary fastening element secured to the top surface of said second comforter section adjacent said fourth primary fastening element, said fourth primary fastening element connectable with said fourth secondary fastening element to detachably fasten said right edge of said second comforter section to itself in a folded configuration, whereby said fourth primary fastening element and said fourth secondary fastening element are hidden and protected when connected.

2. The convertible bed comforter of claim 1, wherein said primary fastening elements include one component of a strip of hook and loop fastening material and said secondary fastening elements include a cooperating component of a strip hook and loop fastening material.

3. The convertible bed comforter of claim 1, wherein said comforter sections have interior quilted fillings.

4. The convertible bed comforter of claim 1, wherein said first comforter section includes a plurality of fasteners secured along its bottom edge, and said second comforter section includes a plurality of fasteners secured along its bottom edge.

5. The convertible bed comforter of claim 4, wherein said plurality of fasteners are alternating male and female snap fasteners.

6. The convertible bed comforter of claim 4 wherein said primary fastening elements include one component of a strip of hook and loop fastening material and said secondary fastening elements include a cooperating component of a strip of hook and loop fastening material.

7. A sleeping bag comprising:

a comforter section including a top surface, a bottom surface, a right edge, a left edge, a top edge, and a bottom edge;

a first and a second primary fastening element and a first and a second secondary fastening element, each said primary fastening element adapted to mate with one of said secondary fastening elements, said first primary fastening element secured to the top surface of said comforter section along the right edge, said first secondary fastening element secured to the top surface of said comforter adjacent said first primary fastening element, said secondary primary fastening element secured to the bottom surface of the left edge, said second secondary fastening element secured to the bottom surface of said comforter adjacent said secondary primary fastening element, said first primary fastening element being connectable with said second secondary fastening element and said second primary fastening element being connectable with said first secondary fastening element to form an elongated pocket, said pocket having a length which may be adjusted by folding said top edge backward to form a double thickness head support, said primary fastening elements including a first primary section adjacent the top edge, said first primary section having a first component of a strip of hook and loop fastening material, and a second primary section adjacent the bottom edge, said second primary section including a second cooperating component of a strip of hook and loop fastening material, and said secondary fastening components including a first secondary section adjacent the bottom edge, said first secondary section having a first component of a strip of hook and loop fastening material, and a second secondary section adjacent the top edge, said second second secondary section including a second cooperating component of a strip of hook and loop fastening material whereby said first primary sections of said primary elements are connectable to said second primary sections and said first secondary sections are connectable to said second secondary sections.

8. The sleeping bag of claim 7, wherein said primary fastening elements include one component of a strip of hook and loop fastening material and said secondary fastening elements include a cooperating component of a strip of hook and loop fastening material.

9. The sleeping bag of claim 7, wherein said comforter section has an interior quilted filling.

10. The sleeping bag of claim 7 wherein said comforter section includes a plurality of fasteners secured along said bottom edge, said plurality of fasteners detachably fastened to each other to close the pocket along the bottom edge.

11. The sleeping bag of claim 10, wherein said plurality of fasteners are alternating male and female snap fasteners.

12. The sleeping bag of claim 11 wherein said primary fastening elements include one component of a strip of hook and loop fastening material and said secondary fastening elements include a cooperating component of a strip of hook and loop material.

13. A sleeping bag comprising:

a first comforter section and a second comforter section, each of said comforters sections including a top surface, a bottom surface, a right edge, a left edge, a top edge and a bottom edge; and a first, a second, a third, and a fourth primary fastening element and a first, a second, a third, and a fourth secondary fastening element, each of said primary fastening elements to mate with one of said secondary fastening elements, said first primary fastening element secured to the top surface of said first comforter section along its right edge, said first secondary fastening element secured to the top surface of said first comforter section adjacent said first primary fastening element, said second primary fastening element secured to the bottom surface of said second comforter section along its left edge, said second secondary fastening element secured to the bottom surface of said second comforter section adjacent said second primary fastening element, said first primary fastening element connectable with said second secondary fastening element and said second primary fastening element connectable with said first secondary fastening element to detachably fasten said right edge of said first comforter section to the left edge of said second comforter section, said third primary fastening element secured to the bottom surface of said first comforter section along its left edge, said third secondary fastening element secured to the bottom surface of said first comforter section adjacent said third primary fastening element, said fourth primary fastening element secured to the top surface of said second comforter section along its right edge, said fourth secondary fastening element secured to the top surface of said second comforter section adjacent said fourth primary fastening element, said third primary fastening element being connectable with said fourth secondary fastening element and said fourth primary fastening element being connectable with said third secondary fastening element to detachably fasten said left edge of said first comforter section to the right edge of said second comforter section, each of said primary fastening elements including a first primary section adjacent said top edge, said first primary section having a first component of a strip of hook and loop fastening material, and a second primary section adjacent said bottom edge, said second primary section including a second cooperating component with a strip of hook and loop fastening material, said secondary fastening elements including a first secondary section adjacent said bottom edge, said first secondary section including a first component of a strip of hook and loop fastening material, and a second secondary section adjacent said top edge, said second secondary section including a second cooperative component of a strip of hook and loop fastening materials whereby said first primary sections of said primary elements are connectable to said second primary sections and said first secondary sections are connectable to said second secondary sections.

14. The sleeping bag of claim 13, wherein said primary fastening elements include one component of a strip of hook and loop fastening material and said secondary fastening elements include a cooperating component of a strip of hook and loop fastening material.

15. The sleeping bag of claim 13 wherein said first comforter section includes a plurality of fasteners along its bottom edge, and said second comforter section includes a plurality of fasteners along its bottom edge.

16. The sleeping bag of claim 15, wherein said pluralities of fasteners are alternating male and female snap fasteners.

17. The sleeping bag of claim 16 wherein said primary fastening elements include one component of a strips of hook and loop fastening material and said secondary fastening elements include a cooperating component of a strip of hook and loop fastening materials.

18. A convertible multi-purpose covering comprising:

a pair of similarly shaped and sized flexible sheets of material having predetermined surfaces and edges positioned in face-to-face relationship at a first location, said sheets being aligned along matching edges thereof and connected together adjacent said sheets top and side marginal edges to form an interior space therebetween, said connected sheets being turned right-side-out, insulating filling being disposed within said space between said connected sheets, said sheets being connected together adjacent said bottom marginal edges to form a first rectangular comforter body having a top surface, a bottom surface, a right side edge, and left side edge, top edge and a bottom edge;

a first and a second detachable connecting means affixed to said top surface of said body in parallel longitudinal rows along said right side marginal edge at predetermined, spaced apart locations;

a third and a fourth detachable connecting means affixed to said bottom surface of said body in parallel longitudinal rows along said left side marginal edge at predetermined, spaced apart locations;

a fifth detachable connecting means affixed to said bottom surface of said body and arranged in a latitudinal row along said bottom marginal edge, said fifth detachable connecting means including mating male and female elements arranged in an alternating sequence at regular, predetermined intervals enabling a second rectangular comforter body to be attached in side-by-side relation to said first comforter body to form optional adult, adolescent and infant size bedding items such as bed comforters, blankets, single and double occupant sleeping bags and body wraps.

19. The convertible multi-purpose covering defined in claim 18 wherein said body is square in shape.

20. The convertible multipurpose covering defined in claim 18 wherein said insulating filling material is of natural material.

21. The convertible multipurpose covering defined in claim 18 wherein said insulating filling material is of man-made material.

22. The convertible multi-purpose covering defined in claim 18 wherein said first detachable connecting means are a plurality of fasteners arranged in a longitudinal row commencing with a male-type fastener adjacent said top marginal edge and thereafter, commencing with a female-type fastener continuing to and terminating adjacent said bottom said marginal edge; said second detachable connecting means being a plurality of fasteners arranged in a longitudinal row at a predetermined, spaced apart second location towards center of said body adjacent and parallel to said first plurality of said fasteners and thereafter commencing with a female-type fastener adjacent said top marginal edge continuing to and terminating mid-way between said top and bottom marginal edges and thereafter commencing with a male-type fastener continuing to and terminating adjacent said bottom marginal edge; said third detachable connecting means being a plurality of fasteners arranged in a longitudinal row commencing with a male-type fastener adjacent said top marginal edge and continuing to and terminating mid-way between said top and bottom marginal edges and thereafter commencing with a female-type fastener continuing to and terminating adjacent said bottom marginal edge; said fourth detachable connecting means being a plurality of fasteners arranged in a longitudinal row at a predetermined, spaced apart second location towards a center of said body adjacent and parallel to said third plurality of said fasteners and commencing with a female-type fastener adjacent said top marginal edge continuing to and terminating mid-way between said top and bottom marginal and thereafter commencing with a male-type fastener continuing to and terminating adjacent said bottom marginal edge; said fifth detachable connecting means being a plurality of alternating male-type and female-type fasteners located towards said center of said body adjacent said fourth plurality of fasteners and terminating with a said female-type fastener located towards said center of said body adjacent said second plurality of fasteners.

23. The convertible multipurpose covering defined in claim 22 wherein said first, second, third, fourth and fifth pluralities of said male-type and female-type fasteners are of hook and loop-type fastening strips.

24. The convertible multi-purpose covering defined in claim 22 wherein said first, second, third, fourth and fifth pluralities of said male-type and female-type fasteners are of ball and socket snap-type fasteners.

25. The convertible multi-purpose covering defined in claim 22 wherein said first, second, third, fourth and fifth pluralities of said male-type and female-type fasteners are of magnetic clasp-type fasteners.

26. The convertible multi-purpose covering defined in claim 22 wherein said first, second, third, fourth and fifth pluralities of said male-type and female-type fasteners are of button and hole-type fasteners.

27. The convertible multi-purpose covering defined in claim 22 wherein said first, second, third, fourth and fifth pluralities of said male-type and female-type fasteners are of slide-type fasteners.

28. The convertible multi-purpose covering defined in claim 22 wherein said first and second pluralities of fasteners, and said third and fourth pluralities of fasteners are adapted to engage each other when aligned in face-to-face relationship folding said covering longitudinally between said pairs of said fastener pluralities to hold said fold in place to form a finished edges.

29. The convertible multi-purpose covering defined in claim 22 wherein said first and second pluralities of fasteners are adapted to engage said third and fourth pluralities of fasteners when said covering is folded over longitudinally to overlap and align said pairs of fastener pluralities in face-to-face relationship to form a secure insulating enclosure seam configuring a tube-shaped embodiment having interior and exterior surfaces.

30. The convertible multi-purpose covering defined in claim 22 wherein either said first and second pluralities of fasteners, or said third and fourth pluralities of fasteners are adapted to engage themselves when said covering is folded over latitudinally mid-way between said top and bottom marginal edges overlapping and aligning either pair of said fastener pluralities in face-to-face relationship onto themselves to form a secure insulating enclosure seam configuring a sack-shaped embodiment having interior and exterior surfaces.

31. The convertible multi-purpose covering defined in claim 22 wherein said first and second pluralities of fasteners of a first said covering are adapted to engage said third and fourth pluralities of fasteners of a second said covering when overlapped and aligned in face-to-face relationship to form a secure insulating attaching seam.

32. The convertible multipurpose covering defined in claim 22 wherein said first and second pluralities of fasteners of a first said covering are adapted to engage said third and fourth pluralities of fasteners of a second said covering when overlapped and aligned in face-to-face relationship to form a secure insulating attaching seam, said third and fourth pluralities of fasteners of said first covering are adapted to engage said first and second pluralities of fasteners of said second covering when overlapped and aligned in face-to-face relationship to form a secure insulating enclosure seam configuring a tube-shaped embodiment having interior and exterior surfaces.

33. The convertible multi-purpose covering defined in claim 22 wherein said fifth plurality of fasteners are adapted to engage at least one said male-type fastener to one said female-type fastener when aligned in face-to-face relationship folding said covering longitudinal for holding said fold or folds in place.

34. The convertible multi-purpose covering defined in claim 28 wherein said fifth plurality of fasteners are adapted to engage when positioned to said interior surface and aligned in face-to-face relationship for enclosing said tube-shaped embodiment's bottom edge.

* * * * *